US005641100A

United States Patent [19]

Mitchell et al.

[11] Patent Number: 5,641,100

[45] Date of Patent: Jun. 24, 1997

[54] GARMENT HANGER INDICATOR SYSTEM

[75] Inventors: Donald Claude Mitchell, Picnic Point; George Millar Robertson, Kingsgrove, both of Australia

[73] Assignee: Rainsfords Pty. Limited, Kingsgrove, Australia

[21] Appl. No.: 411,759

[22] PCT Filed: Sep. 29, 1993

[86] PCT No.: PCT/AU93/00496

§ 371 Date: Mar. 30, 1995

§ 102(e) Date: Mar. 30, 1995

[87] PCT Pub. No.: WO94/07399

PCT Pub. Date: Apr. 14, 1994

[30] Foreign Application Priority Data

| | | | |
|---|---|---|---|
| Sep. 30, 1992 | [AU] | Australia | PL5034 |
| Apr. 20, 1993 | [AU] | Australia | PL8372 |
| Jul. 1, 1993 | [AU] | Australia | PL9750 |

[51] Int. Cl.[6] ..... A47G 25/14

[52] U.S. Cl. ..... 223/85; 40/322; 40/611

[58] Field of Search ..... 40/322, 5, 642, 40/611; 223/85

[56] References Cited

U.S. PATENT DOCUMENTS

| | | | |
|---|---|---|---|
| 600,074 | 3/1898 | Harding | 40/642 |
| 1,348,952 | 8/1920 | Landry | 40/642 |
| 1,389,266 | 8/1921 | Newton . | |
| 1,840,193 | 1/1932 | Feldman et al. | 40/5 |
| 2,801,036 | 7/1957 | Klein | 40/322 X |
| 3,949,914 | 4/1976 | Ostroll | 223/85 |
| 4,017,990 | 4/1977 | Garrison | 40/322 |
| 4,270,292 | 6/1981 | Eckberg | 40/5 |
| 4,450,639 | 5/1984 | Duester | 40/322 |
| 4,765,077 | 8/1988 | Rosenthal et al. | 40/611 |
| 5,056,248 | 10/1991 | Blanchard | 40/322 X |
| 5,135,141 | 8/1992 | Harmer et al. | 223/85 |
| 5,199,608 | 4/1993 | Zuckerman | 223/85 |
| 5,238,159 | 8/1993 | Zuckerman | 223/85 |
| 5,366,192 | 11/1994 | Carroll | 40/642 |
| 5,381,938 | 1/1995 | Vasudeva | 40/322 X |

FOREIGN PATENT DOCUMENTS

| | | | |
|---|---|---|---|
| 55988/80 | 6/1980 | Australia . | |
| 57011/80 | 10/1980 | Australia . | |
| 26077/84 | 10/1982 | Australia . | |
| 48946/90 | 8/1990 | Australia . | |
| 16332/92 | 1/1993 | Australia . | |
| 484483 | 2/1970 | Switzerland | 40/611 |
| 90/09651 | 8/1990 | WIPO . | |

*Primary Examiner*—Bibhu Mohanty

*Attorney, Agent, or Firm*—Jacobson, Price, Holman & Stern, PLLC

[57] ABSTRACT

A moulded plastic garment hanger (1) adapted to support an indicia means, said garment hanger comprising a hook (2) and at least one portion (4) against which said indicia means is supported, wherein said indicia means is a plate member (10) releasably held to said portion by at least one projection (6, 7, 8) positioned at or near the periphery of said portion.

7 Claims, 5 Drawing Sheets

GARMENT HANGER INDICATOR SYSTEM

TECHNICAL FIELD

This invention relates to garment hangers and in particular to indicator means on such garment hangers to indicate details such as garment size and/or the manufacturer or retailer of the garment being supported.

BACKGROUND

Known indicator means for garment hangers are generally bulky, costly to make, obtrusive and in many instances are in the form of a cap or extension member projecting from the hanger. Many such indicator means add considerable cost to the use of garment hangers by retailers and/or manufacturers during the life of a garment hanger.

It is therefore an object of the present invention to provide a less costly and less obtrusive and easy to use alternative to the known indicator means for garment hangers.

DISCLOSURE OF INVENTION

In one form the present invention is a moulded plastic garment hanger adapted to support an indicia means, said garment hanger comprising a hook and at least one portion against which said indicia means is supported, wherein said indicia means is a plate member releasably held to said portion by at least one projection positioned at or near the periphery of said portion, said plate member being held in a recess between said projection and the plane of the surface of said portion.

In a further form the present invention is a moulded plastic garment hanger comprising a hook, at least one indicia means and at least one portion adapted to support said indicia means, wherein said indicia means is a plate member releasably held at or near said portion by at least one projection positioned at or near said periphery of said portion, said plate member being held in a recess between said projection and the plane of the surface of said portion In a further preferred embodiment the hanger further comprises a spring clip integral with said portion adapted to hold said indicia means against said projection.

In a further preferred embodiment the hanger of the present invention comprises a protrusion which is sloped and/or curved projecting from said portion.

BRIEF DESCRIPTION OF DRAWINGS

The invention will now be described by way of non-limiting examples and with reference to the accompanying illustrations.

MODES FOR CARRYING OUT INVENTION

Figure 1:
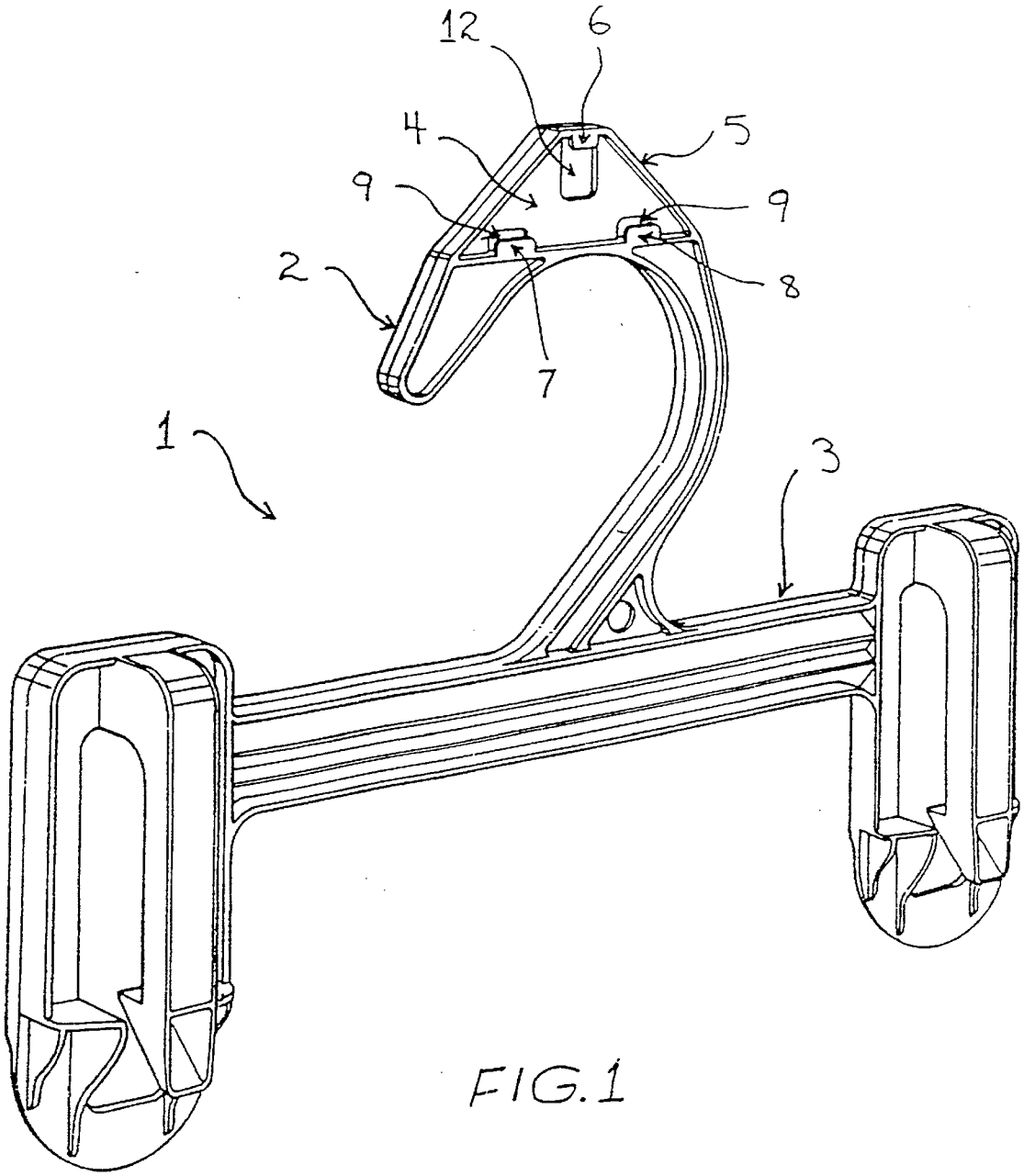
FIG. 1. is an elevational view of a garment hanger adapted to removably receive an indicator means in a first embodiment.

In one embodiment, as shown in FIG. 1 a garment hanger 1 comprises a hook 2 which is attached to an arm 3. The hook 2 having a mounting surface 4 on one of its faces at its upper region. The mounting surface 4 being substantially flat and having a ridge 5 running around its periphery.

The ridge 5 having three projection 6, 7, 8 protruding therefrom inwardly over the plane in which the surface 4 lies, thus forming a small recess or gap 9 between each of projections 6, 7, 8 and the plane of surface 4.

Preferably, where the garment hanger 1 is of moulded plastic, the projections 6, 7, 8 project out over the plane of mounting surface 4 about 1 mm to 2 mm from the centreline of the ridge. Further the small gaps 9 are preferably about 0.75 mm to 1 mm.

Figure 2:
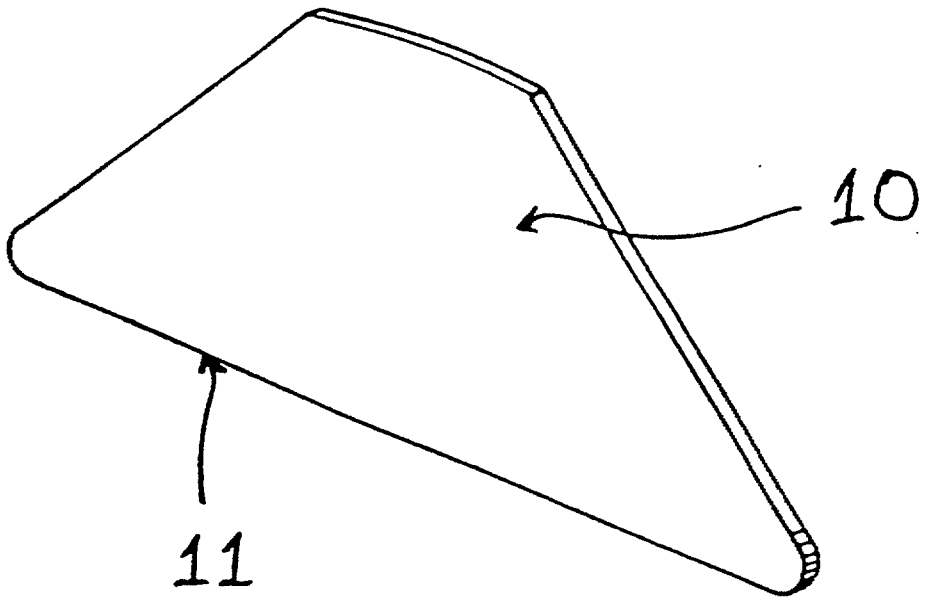
FIG. 2. is an enlarged perspective view of an indicator means (tag) adapted to fit onto the hook of FIG. 1.

Utilising such dimensions would allow a suitably shaped indicator tag 10, see FIG. 2, made preferably of 0.5 mm thick high impact polystyrene to be fitted against the mounting surface 4 surrounded by ridge 5. The resilience of such an indicator tag 10 would be sufficient to allow it to flex enough such that portions of its edges can be positioned behind the projections 6, 7, 8 in the small gaps 9 and held against or near the mounting surface 4 by the projections 6, 7, 8.

The mounting surface 4 has an opening 12 therethrough. The primary purpose for opening 12 is to allow tag 10, when placed behind projections 7 and 8 and against projection 6, to deflect into opening 12 allowing it to slip behind projection 6. The opening 12 also allowing for easy removal of the indicator tag 10 by pushing a suitable implement (such as a pen or other pointed device) through opening 12 from the side opposite the mounting surface 4. The implement is pushed against the fitted tag 10, which will flex sufficiently such that it can be removed from the projections 6, 7, 8 and taken off the mounting surface 4.

Figure 3:
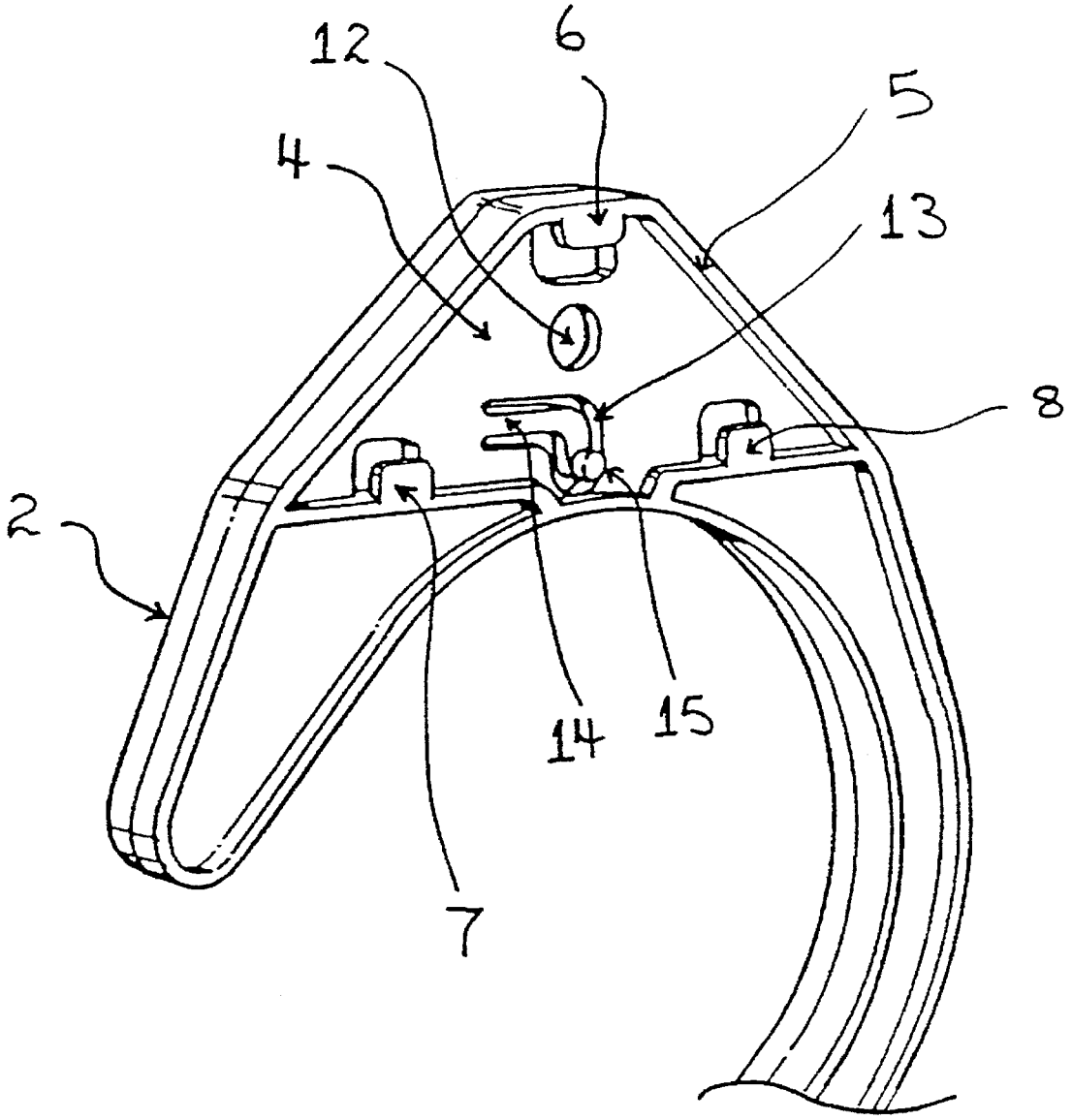
FIG. 3. is a perspective view of a hook portion of a garment hanger adapted to removably receive an indicator means in a second embodiment.

FIG. 3 shows a second embodiment of the invention in which the hook 2 of a garment hanger is provided with a spring clip 13 projecting from and integral with the mounting surface 4. Parts similar to those described in FIG. 1 are given similar reference members.

The opening 12 of the second embodiment, however, differs from the previous embodiment in that it is not adjacent to projection 6 but is a separate opening near the centre of the mounting surface 4. Its purpose being the same as in the previous embodiment.

The spring clip 13 is in the shape of a bent finger 14 cut out from and lying in the same plane as the mounting surface 4. At the free end of the bent finger 14 is a protrusion 15 extending away from the plane of the mounting surface 4. In this embodiment the protrusion 15 is cylindrical and extends a distance from the plane of the mounting surface substantially the same as that of small gaps 9.

Where the hanger is of moulded plastic the bent finger 14 is sufficiently resilient to flex when a indicator tag 10 as shown in FIG. 2 is mounted on mounting surface 4.

The tag 10 is mounted by positioning it over the mounting surface 4 against the protrusion 15 and under projections 7 and 8. Pressure is applied to tag 10 which forces the protrusion 15, which in turn flexes the bent finger 14 away from the plane of the mounting surface 4 towards the other side of hook 2. This action allowing the tag 10 to be fitted under projection 6. The resilient nature of spring clip 13 holds the tag in position against projections 6, 7, 8.

Figure 4:
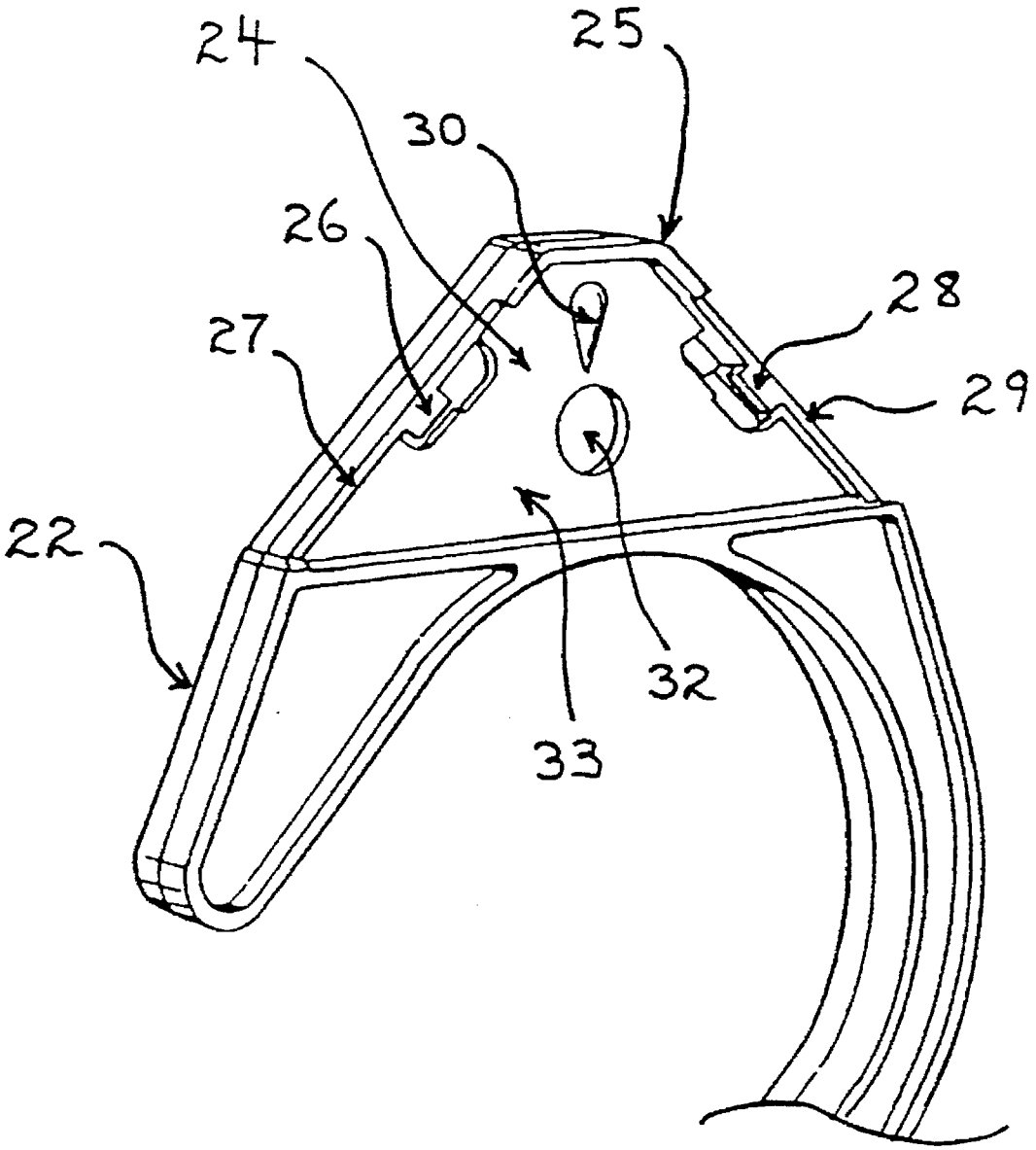
FIG. 4. is a perspective view of a hook portion of a garment hanger adapted to removably receive an indicator means in a third embodiment.
Figure 5:
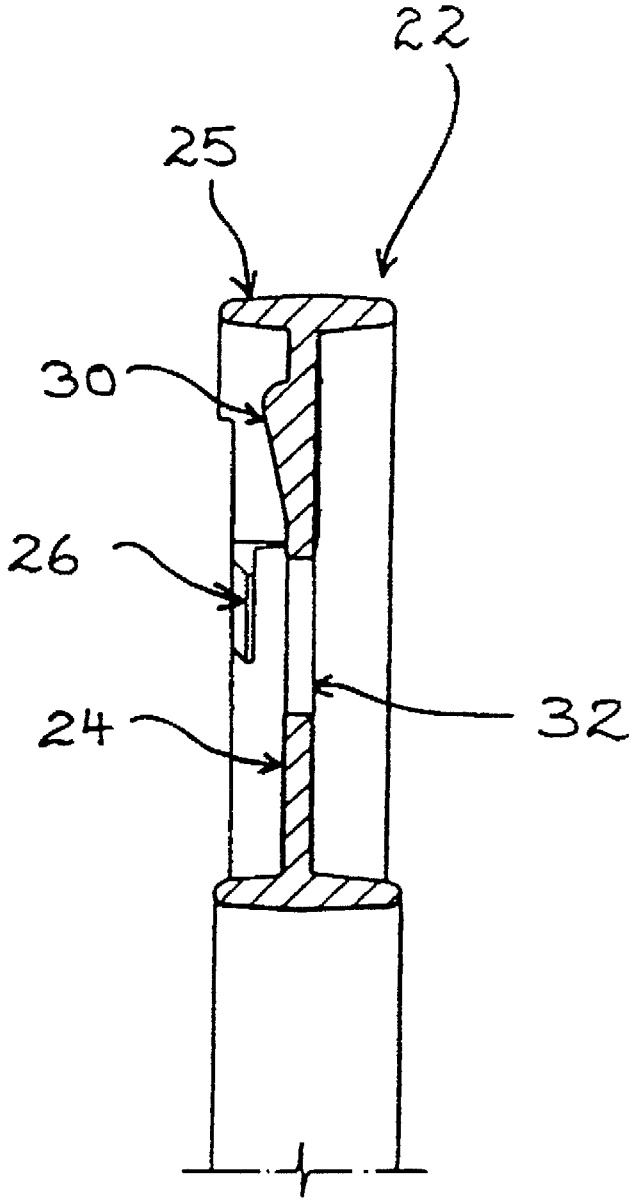
FIG. 5. is an enlarged cross sectional view of section C—C of the upper portion of the hook in FIG. 4.

FIG. 4 shows a third embodiment of the invention in which a hook 22 has a ridge 25 surrounding a mounting surface 24, the ridge 25 having two projections 26 and 28 projecting therefrom (not unlike the first embodiment shown in FIG. 1). However, the positioning of the projections 26 and 28 are along portions 27 and 29, respectively, of the ridge 25.

A sloping (or curved) protrusion 30 (shaped somewhat like an inverted tear drop) is positioned centrally and integrally on the mounting surface 24. In use when a tag 10 (as shown in FIG. 2) is positioned under the projections 26 and 28 against the mounting surface 24, the sloping protrusion 30 acts against the resilient tag 10 and holds it in place against the projections 26 and 28, the lower edge 11 of the tag 10 being held against the lower portion 33 of the mounting surface 24.

Due to the resilience of the indicator tag 10 it can be easily fitted and removed from the mounting surface 24 (similar to that of the first embodiment). Also as in the first and second embodiments an opening 32 (similar to opening 12) is provided to allow for removal of the tag 10 by use of an implement as in the previous embodiments.

In a further not shown embodiment the configuration of the third embodiment could be such that it can be used on both sides of the hook ie. opposed mounting surfaces and projections could be provided on the hook, with sloping projections on each opposed mounting surface, allowing for an indicator tag to be fitted to both sides of the hook. In such an arrangement a recess positioned along the ridge could be provided on one side of the hook to allow for removal of one of the opposed indicator tags, as use of two tags prevents access to the central opening.

The shape of the mounting surface, projections, sloping projection, indicator tag, spring clip and openings on the hooks of the present embodiments could vary in further not shown embodiments. For instance, in one not shown embodiment, the mounting surface may be positioned at the lower hook portion of a garment hanger. In further not shown embodiments the mounting surface may be positioned below the hook portion on the body or arms of the garment hanger or may project from any portion of the garment hanger.

All of the embodiments of the invention allow for a relatively cheap and inexpensive tag to be removably fitted with ease to the hook of a garment hanger. This would allow manufacturers/retailers to reuse garment hangers and remove and interchange tags as required.

It will be apparent to those skilled in the art that many modifications and variations may be made to the embodiments described herein without departing from the scope of the invention.

We claim:

1. A molded plastic garment hanger adapted to support an indicia means in the form of a plate member, said garment hanger including a hook, at least one portion against which said indicia means is supported, at least one projection positioned at or near the periphery of said portion for releasably holding the plate member to said portion, said plate member being held in a recess between said projection and the plane of the surface of said portion, and a protrusion arranged to project from the said portion thereby urging said plate member against said projection when said plate member is being supported, the protrusion being configured for the plate member to flex thereabout so as to allow the plate member to be fitted between the plane of the surface of said portion and the at least one projection during introduction of the plate member into said recess.

2. A molded plastic garment hanger comprising a hook, at least one indicia means, at least one portion adapted to support said indicia means, said indicia means is a plate member releasably held at or near said portion by at least one projection positioned at or near said periphery of said portion, and a protrusion arranged to project from the said portion thereby urging said plate member against said projection when said plate member is being supported, wherein said plate member is held in a recess between said projection and the plane of the surface of said portion, and the protrusion being configured for the plate member to flex thereabout so as to allow the plate member to be fitted between the plane of the surface of said portion and the at least one projection during introduction of the plate member into said recess.

3. A molded plastic garment hanger adapted to support an indicia means, said garment hanger comprising a hook and at least one portion against which said indicia means is supported, wherein said indicia means is a plate member releasably held to said portion by at least one projection positioned at or near the periphery of said portion, said plate member being held in a recess between said projection and the plane of the surface of said portion and wherein a biased spring clip projects from said portion thereby urging said plate member against said projection when said plate member is being supported.

4. A molded plastic garment hanger as claimed in claim 3, wherein said spring clip comprises a finger member integrally formed with said portion, said finger member having a protrusion at its free end.

5. A molded plastic garment hanger adapted to support an indicia means, said garment hanger comprising a hook and at least one portion against which said indicia means is supported, wherein said indicia means is a plate member releasably held to said portion by at least one projection positioned at or near the periphery of said portion, said plate member being held in a recess between said projection and the plane of the surface of said portion and wherein a protrusion is projected from the surface of said portion thereby urging said plate member against said projection when said plate member is being supported.

6. A molded plastic garment hanger as claimed in claim 5, wherein said protrusion has a sloped surface.

7. A molded plastic garment hanger as claimed in claim 5, wherein said protrusion has a curved surface.

* * * * *